United States Patent [19]

Yui

[11] Patent Number: 4,609,421

[45] Date of Patent: Sep. 2, 1986

[54] AUTOMATIC ENVELOPE SEALING DEVICE

[75] Inventor: Yoshikazu Yui, Chiba, Japan

[73] Assignee: Silver Seiko Ltd., Japan

[21] Appl. No.: 699,727

[22] Filed: Feb. 11, 1985

[30] Foreign Application Priority Data

Feb. 15, 1984 [JP] Japan ..... 59-26825

[51] Int. Cl.[4] ..... B65B 51/02

[52] U.S. Cl. ..... 156/442.1; 118/243; 156/443; 493/177; 493/260; 493/264

[58] Field of Search ..... 156/442.1, 442.2, 442.3, 156/442.4, 443, 475, 486, 478–480; 493/260–262, 177, 263, 264, 267, 245, 249; 118/243

[56] References Cited

U.S. PATENT DOCUMENTS 636,690 11/1899 Nielsen ..... 156/442.1
1,886,832 11/1932 Novick ..... 493/260

FOREIGN PATENT DOCUMENTS 250254 2/1911 Fed. Rep. of Germany .
115540 7/1925 Fed. Rep. of Germany .
31-12303 7/1956 Japan .
52-20097 2/1977 Japan .
55-53598 4/1980 Japan .
55-50000 11/1980 Japan .

*Primary Examiner*—David Simmons
*Attorney, Agent, or Firm*—Lane and Aitken

[57] ABSTRACT

An automatic envelope sealing device wherein envelopes of different sizes can be sealed without adjustment any component of the device. A size of an enveloped supplied into the device is detected by a sensor, and in response to a signal from the sensor, a movable stopper is alternatively extended into a plane in which the envelope is to be fed or retracted in order to stop the large size envelope thereat or retracted therefrom to allow the small size envelope to be fed until it is stopped by a fixed stopper. A flap of the envelope is then bent positively and paste in a controlled amount is applied to the flap whereafter the envelope is fed reversely until it is discharged outside the device. During the reverse feeding, the flap is pressed to be adhered to the envelope by cooperating rollers which act as feeding means.

10 Claims, 5 Drawing Figures

AUTOMATIC ENVELOPE SEALING DEVICE

BACKGROUND OF THE INVENTION

This invention relates to a device for automatically sealing envelopes, and more particularly to an automatic envelope sealing device wherein existing envelopes of different sizes can be sealed automatically without adjustment of the device.

Several proposals have been made so far for automatic envelope sealing device wherein existing envelopes of different sizes or different paper qualities can be sealed. All of such proposed devices have defects that fine adjustments are necessary depending upon a width and length of envelopes, an amount of paste to be applied and a location of an envelope to which paste is to be applied, and so on, that since a flap of an envelope is slided along a guide to turn it over during feeding of the envelope after paste has been applied to the flap, if the envelope has been introduced improperly or if the guide is soiled by paste, then the flap will not be bent properly or the envelope will be jammed, resulting in the necessity of adjustments or corrections of the device so that only a person who is very familiar to the device can use the device satisfactorily, and that maintenance such as cleaning or adjustments of the paste container and guide is required after use of the device.

SUMMARY OF THE INVENTION

It is an object of the present invention to provide an automatic envelope sealing device which eliminates such defects of conventional devices as described above and wherein an operation for bending a flap of an envelope is made surer, eliminating the necessity of amending or correcting operations of the device, and existing envelopes of different sizes can be used or sealed without any adjustment of the device while maintenance operations such as cleaning of the device after use are eliminated.

According to an aspect of the present invention, there is provided an automatic envelope sealing device which comprises a supply table, a receiving table, feeding means for feeding an envelope supplied from the supply table to the receiving table, bending means for bending a flap of the envelop on the receiving table, liquid storing means located below a plane of the receiving table on which an envelope is placed, and applying means mounted corresponding to the liquid storing means for up and down movement between the liquid storing means and the envelope placed on the plane for applying liquid to a reverse face of the bent flap of the envelope.

According to another aspect of the invention, there is provided an automatic envelope sealing device which comprises a receiving plate mounted at an end of the envelope receiving table and located corresponding to and below a flap of an envelope placed on the envelope receiving table, the receiving plate having an upwardly extending portion, and bending means located corresponding to and above the receiving plate and mounted for downward movement into engagement with the receiving plate for bending the flap of the envelope.

According to a further aspect of the invention, there is provided an automatic envelope sealing device which comprises detecting means located adjacent the supply table for detecting a size of an envelope supplied from the supply table from which envelopes of small and large sizes can be supplied, and controlling means operable in response to a signal from the detecting means to position the flap of the envelope thus supplied to a fixed position on the receiving table.

Other aspects of the present invention will become apparent as the following description proceeds and upon reference to the drawings.

DETAILED DESCRIPTION OF THE INVENTION

Figure 5:
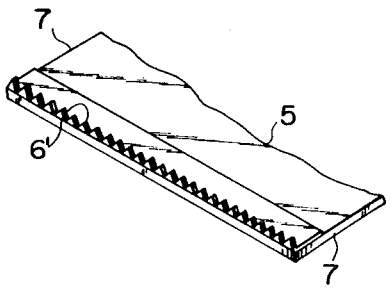
FIG. 5 is a perspective view of a receiving plate in a modified form.

A pair of left and right frame members 1 are secured in opposing relationship to each other by means of a plurality of rods 2 and nuts 3. An envelope supply stand 4 and a receiving table 5 are held by and between the frame members 1. A receiving plate 6 is secured at and extends upwardly from a forward edge of the receiving table 5 which has a pair of cutaway portions 7 formed at opposite edges adjacent the forward edge thereof. The receiving plate 6 is resilient enough in a vertical direction to allow the same to yield when it is pressed down. The receiving plate 6 may be serrated as at 6' as shown in FIG. 5. A flap bending element 8 is bent obliquely downwardly at an end 9 thereof and has a flat plate 11 fixedly mounted on a bottom face thereof. A groove 10 is defined between the bent portion 9 of the flap bending element 8 and the flat plate 11 so as to fit with the receiving plate 6. The flap bending element 8 is secured at the base end thereof to a shaft 17 on which a lever 16 is mounted. The lever 16 is urged to rotate the shaft 17 by a coil spring 15 and is connected to a link 14 which is in turn connected to a crank pin 13 mounted on a cam 12. The flap bending element 8 has a pair of holes 19 formed therein which can receive therein a holding bar 18 mounted at opposite ends thereof for pivotal motion for controlling deflection or deformation of an envelope.

Figure 4:
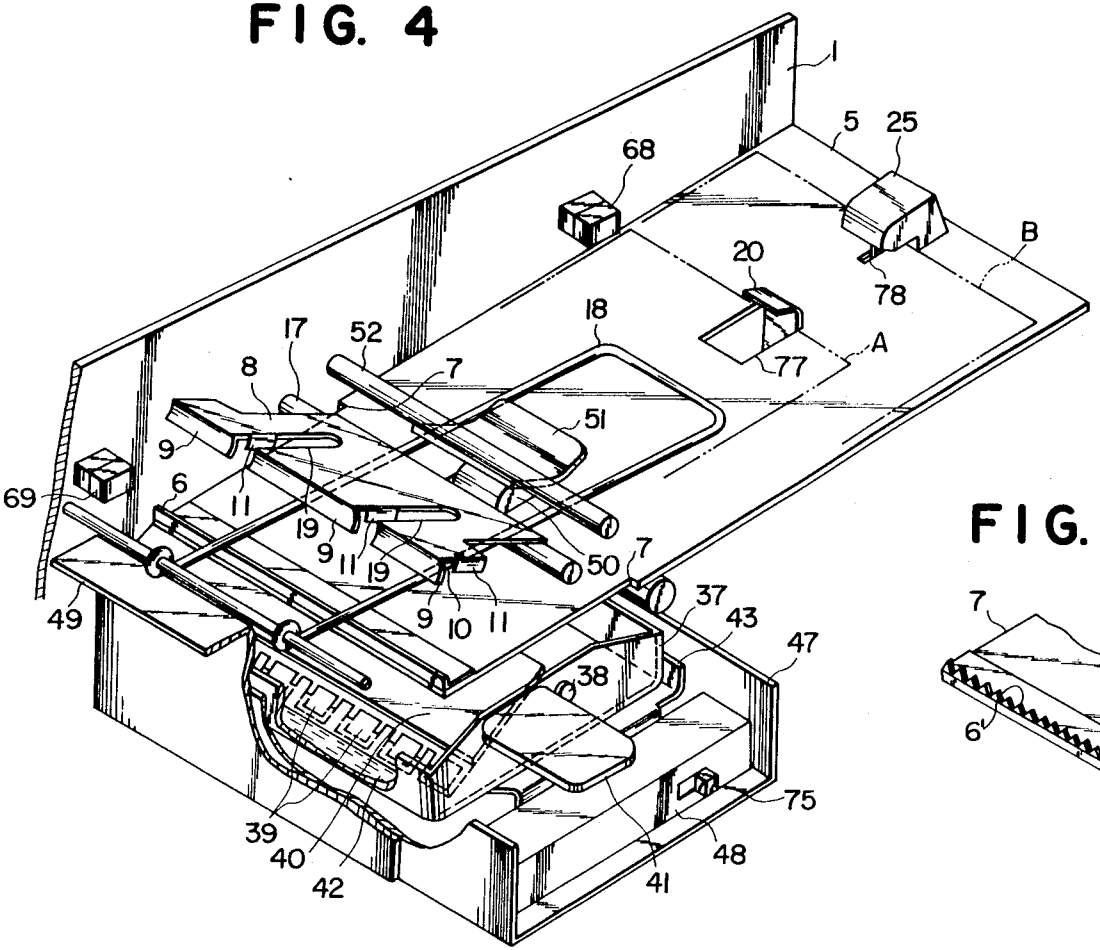
FIG. 4 is a partial perspective view showing an envelope receiving table and a container mounting means.

A movable stopper 20 is mounted for pivotal motion above and below the receiving table 5 on a shaft 22 which is in turn mounted on a bracket 21 located on a bottom face of the receiving table 5. The movable stopper 20 is connected at an intermediate portion thereof to a solenoid 24 by means of a link 23. The movable stopper 20 is located corresponding to a position of a bottom edge of a small size envelope A placed in position on the receiving table 5 as seen in FIG. 4. Meanwhile, a fixed stopper 25 is secured to a rear portion of the receiving table 5 corresponding to a position of a bottom edge of a usable maximum size envelope B placed in position. A microswitch is located on a bottom face of the receiving table 5 and has a contact element 27 located to extend just in front of the fixed stopper 25.

A cam motor 28 has a shaft on which a cam 12 is mounted. A reversing switch 30 and a stopping switch 31 are mounted on a switch bracket 29 and located around the cam 12. A lever 32 is mounted for pivotal motion on a shaft 34 and has a guideway 33 formed therein, and the crank pin 13 is received in the guideway 33 of the lever 32 so as to provide intermittent motions to the lever 32. The lever 32 is connected to a shaft 38 by means of a link 35 and a lever 36. The shaft 38 is removably mounted on a paste container 37 and has a paste applying member 40 secured thereto. The paste applying member 40 may be in the form of a plate having paste letting holes 39 formed at a free edge thereof or in the form of a steel wire (not shown) for allowing excessive paste to drop from the paste applying member 40.

A handle 41 made of a heat insulating material is located on a side wall of the paste container 37, and thermally meltable paste or conventional adhesives may normally be contained in the paste container 37. However, where adhesive envelopes having bonding agent already applied in dried or solid state to their flaps or some other portions are to be used, water may be contained in the paste container 37.

A heat plate 43 is bent at an end thereof on which a thermostat 44 is mounted for controlling a heater 45 secured to a bottom face of the heat plate 43. Reference numeral 46 designates a heat insulating member, 47 a heat plate mounting bracket, 48 a heat plate cover, 49 a flap holding table, and 50 a center roller. A pressure plate 51 is mounted on a rocking shaft 52 and is adapted to be pressed against the center roller 50. A lever 53 is mounted at an end of the rocking shaft 52 and is connected to a solenoid 55 by means of a link 54. The solenoid 55 is energized to press the pressure plate 51 against the center roller 50 only when an envelope is to be discharged.

A feed roller 56 is mounted for rotation to feed an envelope inserted through the supply table 4 to the receiving table 5. A pressure roller 59 is mounted for rotation on a pair of left and right rockably mounted beariung levers 58 and is urged into pressure contact with the feed roller 56 by a spring 60 attached to one of the bearing levers 58. The center roller 50 and the feed roller 56 are each supported by means of bearings 61 which are each screwed to the left or right frame member 1. Pulleys 62 are mounted on shafts of the rollers 50 and 56 and are connected to a pulley 64 mounted on a main motor 63 by means of a belt 65 so that they may be rotated by the main motor 63.

The envelope sealing device further includes a supply guide 66 for a small envelope installed on the supply tble 4, a photosensor 67 for detecting a width of an envelope, another photosensor 68 for detecting an envelope placed on the receiving table 5, a further photosensor 69 for detecting that an envelope is discharged, an electronic controlling device 70 for controlling the entire device, a front plate 71 on which a power switch 72 is mounted, a back plate 73, a side cover 74, and a heater switch 75.

Reference numeral 76 designates a mounting hole for the center roller 50, 77 an opening through which the movable stopper 20 moves, 78 a hole through which the contact element 27 rocks, and 80 a roller mounting hole.

Operations of the envelope sealing device will now be described. At first the heater switch 75 is turned on to cause the heater 45 to generate heat. The temperature is maintained constant by means of the thermostat 44 mounted at a bent end of the heat plate 43, and in about four or five minutes, solid, thermally meltable paste 42 put in prior in the paste container 37 will be melted to a viscosity sufficient to allow application of the paste 42.

Then, the power switch 72 is turned on to operate the main motor 63 and the electronic controlling device 70. Thereafter, envelopes may be suitably inserted from the supply table 4.

In particular, on one hand, an envelope of a small size may be placed inside of the supply guide 66, and on the other side, an envelope of a large size may be placed on and across the supply guide 66, with the bottom thereof directed forwardly. In case of the latter envelope, the width detecting photosensor 67 is contacted and operated by the envelope so that the electronic controlling device 70 energizes the solenoid 24 to pull the link 23 against the urging of the spring 23 provided thereto to rock the movable stopper 20 from a full line position in FIG. 2 extending upwardly through the opening 77 to a phantom position in the opening 77. At this instant, the photosensor 68 for detecting an envelope placed on the receiving table 5 is deenergized to stop functioning thereof.

On the other hand, in case of a small size envelope, the sensor 67 is not contacted by the envelope because the envelope has a smaller width, and hence the movable stopper 20 remains to extend upwardly through the receiving table 5. Accordingly, the photosensor 68 for detecting an envelope placed on the receiving table 5 is kept energized.

Figure 1:
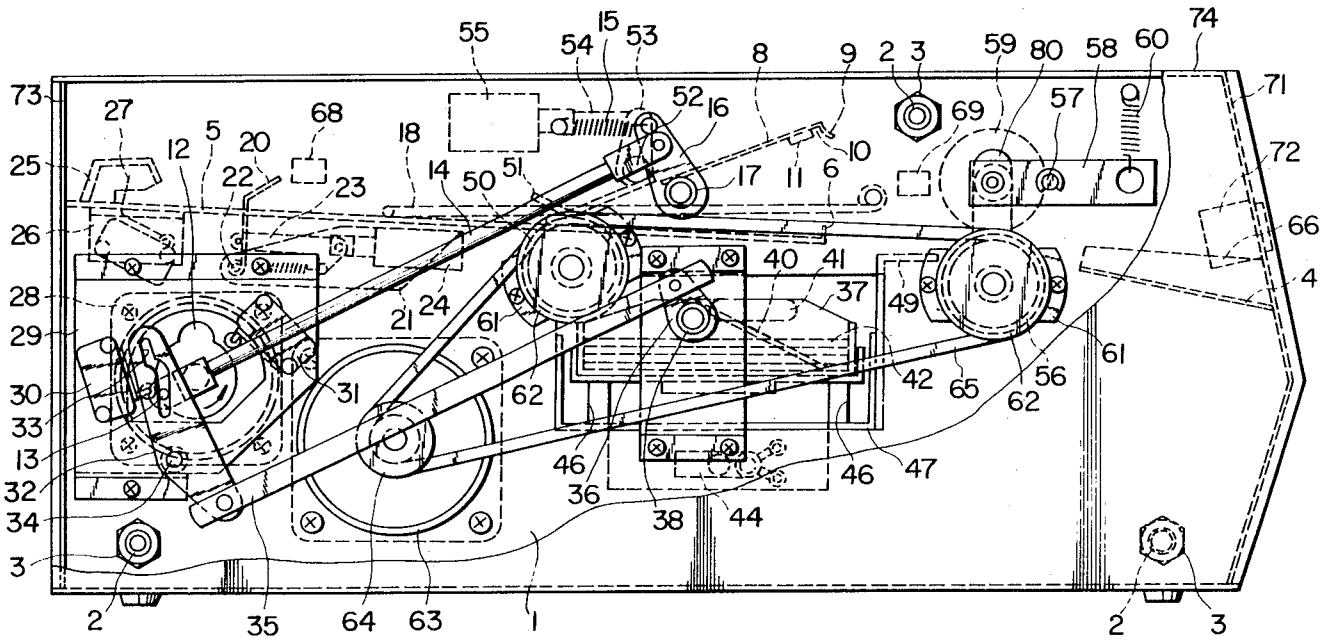
FIG. 1 is a left-hand side elevational view of an automatic envelope sealing device according to the present invention, with a side cover partly broken.
Figure 2:
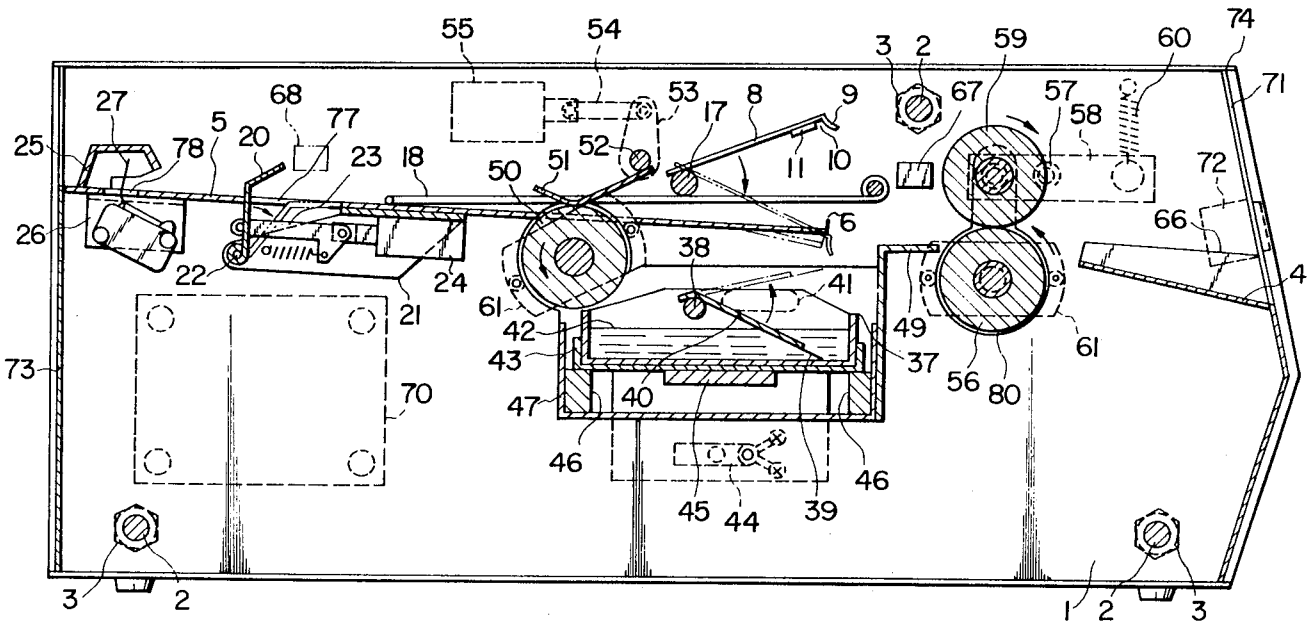
FIG. 2 is a vertical sectional view of the envelope sealing device of FIG. 1.
Figure 3:
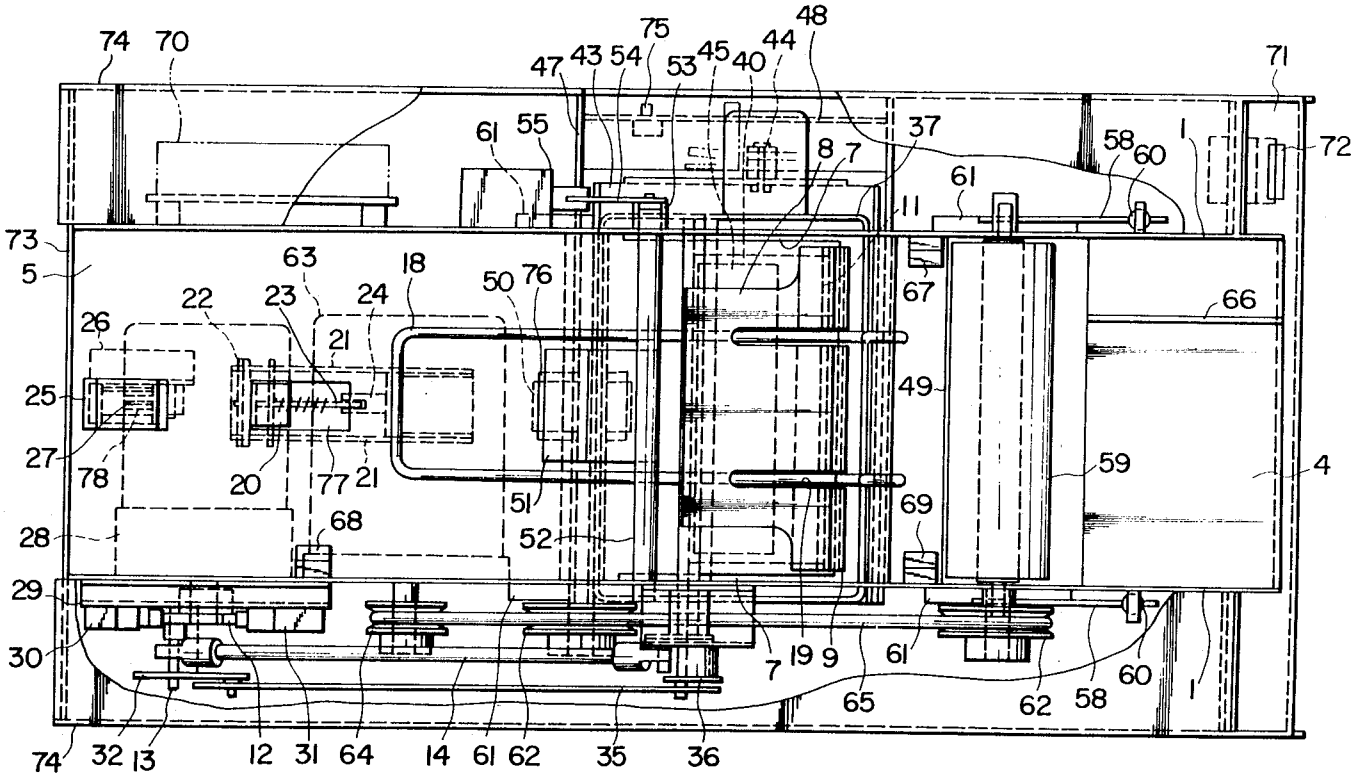
FIG. 3 is a plan view of the entire envelope sealing device of FIG. 1, with left and right side covers partly broken.

Since the rollers 50, 56 and 59 are rotating in directions as indicated by arrow marks in FIG. 2, the envelope supplied is fed in a leftward direction in FIG. 2 until the bottom edge thereof is abutted either against the movable stopper 20 (in case the envelope is of the small size) as indicated at A or against the fixed stopper 25 (in case the envelope is of the large size) as indicated at B.

The movable and fixed stoppers 20 and 25 are positioned such that an envelope of the small or large size in the abutted position has a bending line for a flap thereof positioned on the receiving plate 6. And in response to an operation of the photosensor 68, the electronic controlling device 70 controls the motor 28 to make one complete rotation.

As the cam 12 is thus rotated in a direction as indicated by an arrow mark in FIG. 2, the crank pin 13 slides along the guideway 33 to advance and stop and then return the lever 32. As the lever 32 is advanced or pivoted in the clockwise direction, the applying member 40 in a lowered position in the paste container 37 is rocked up, via the link 35 connected to the lever 32, the lever 36 and the shaft 38, with a suitable amount of paste sticking to an end thereof. Then, the applying member 40 is temporarily held to the thus rocked position.

Although the end of the applying member 40 was initially contacted with the bottom of the paste container and immersed in the thermally melted paste 42, as the applying member 40 is rocked upwardly, an excessive amount of the paste 42 is dropped from the applying member 40 due to the presence of the paste letting holes 39 formed therein.

Meanwhile, the flap bending element 8 is operated by the crank pin 13 via the link 14 and the lever 16 to pivot downwardly in the clockwise direction whereupon the envelope is clamped along the bending line for the flap thereof between the receiving plate 6 and the flat plate 11 on the underside of the flap bending element 8 and the flap is firmly bent downwardly into contact at the bottom face thereof with the end of the applying member 40 in the upwardly rocked position to allow the paste to be applied to the bottom face of the envelope.

Then, as the crank pin 13 is further operated, the flap bending element 8 and the applying member 8 are reversely pivoted upwardly and downwardly to their initial positions, respectively.

At a suitable point of time during rotation of the cam 12, it is contact with the reversing switch 30 so that the main motor 63 is reversed while the solenoid 55 is energized to press the pressure plate 55 against the center roller 50 via the link 54 and the lever 53.

Thus, since the envelope the flap of which has been bent and has paste applied thereto is pressed against the center roller 50 by the pressure plate 51, it is moved toward the supplying table 4 with the flap thereof directed forwardly while the upper face thereof is held by the holding bar 18. Meanwhile, the flap of the envelope is guided by the flap holding table 49 and is introduced between and pressed by the feed roller 56 and the pressure roller 59 to be adhered to the envelope. The envelope is thereafter discharged outside the envelope sealing device.

As has been already mentioned, where adhesive envelopes having bonding agent already applied in dried or solid state to their flaps or some other portions are to be used, water may be contained in the paste container 37. In such a case, instead of bonding agent, water is applied to a flap of an envelope during such a paste applying step as described hereinabove. Consequently, the paste on the flap will be wet with water and become adhesive so that the flap will be firmly adhered to the envelope when it is pressed against the latter by the rollers 56 and 59.

The cam 12 which further continues its rotation then comes into contact with the stop switch 31 so that the envelope discharging detecting photosensor 69 is rendered operative while the power for the cam motor 28 is turned off to stop rotation of the cam 12.

While the envelope is being discharged outside, it is contacted with the envelope discharging detecting photosensor 69 in its operative condition. Consequently, after the envelope has passed by the photosensor 69, the electronic controlling device 70 controls the main motor 63 to rotate again in the forward direction to release the pressing operation of the pressure plate 51 in order to prepare for a subsequent sealing operation.

Experiments have revealed that a device of the embodiment operates at such a very high speed as to seal an envelope in 0.7 or 0.8 seconds or so.

The automatic envelope sealing device according to the embodiment of the present invention described above have various advantages as described below: first, the device can be used easily without any adjustment of the device simply after operation of the power switch.

Particularly, proper positioning of envelopes of different sizes on the receiving table is automatically attained by the movable stopper which is controlled to extend upwardly from or retreat into or below the envelope receiving plane in response to a signal from a sensor or detecting means for detecting a size of an enveloped supplied to the device while paste in a suitable controlled amount can be applied to common portions of flaps of the envelopes.

Secondly, where paste of the thermally meltable type is used, solidified paste will be melted if heated, which allows repetitive or intermittent use of the paste, eliminating the necessity of cleaning of associated elements of the device and allowing the device to be left as the use of it is ended. Further, the paste after applied to an envelope can be readily dried by cooling and prevents natural exfoliation of the flap of the envelope.

Thirdly, since the rollers are reversed quickly after an envelope has been supplied and hence another envelope can be supplied only after a sealing operation for the preceding envelope has been completed, operations in error arising from dual supplies of envelopes can be eliminated.

Fourthly, since an envelope supplied is discharged from a portion of the device from which it was supplied to the device, only a small spacing is required for operation of the device and an operator can use the device without moving around the device.

Fifthly, since bending of a flap of an envelope is assured by preliminary bending by the receiving plate and the cooperating groove of the flap bending element, the flap may not be caught by a guide nor be bent obliquely as distinct from conventional devices in which an envelope is turned over by a guide and is bent by a pressure roller.

What is claimed is:

1. An automatic envelope sealing device, comprising: an envelope receiving table for receiving an envelope thereon; a receiving plate mounted at an end of said envelope receiving table and located below an envelope placed on said envelope receiving table and at a position adjacent to a flap of such envelope, said receiving plate having a portion extending upwardly from the forward edge of said receiving table; and bending means located above and corresponding to said receiving plate and mounted for downward movement into engagement with said receiving plate for bending the flap of the envelope downwardly over said upwardly extending portion.

2. An automatic envelope sealing device as claimed in claim 1, wherein said bending means is mounted for pivotal motion on a shaft and has a downwardly bent end and a groove adapted to be engaged by said upwardly extending portion.

3. An automatic envelope sealing device as claimed in claim 1, wherein said receiving plate has a horizontal portion secured to the envelope receiving table and extending at least over the entire width of the flap of the envelope.

4. An automatic envelope sealing device as claimed in claim 3, wherein said horizontal portion of said receiving plate is resiliently yielded vertically when pressed downwardly.

5. An automatic envelope sealing device as claimed in claim 3, wherein said receiving plate is serrated at said vertical portion thereof.

6. An automatic envelope sealing device, comprising: means defining a plane for receiving an envelope thereon; a liquid storing means located below said plane for storing liquid such as bonding agent or water therein; and applying means having an applying member mounted for pivotal movement between a position immersed in liquid contained in said liquid storing means and a position to apply liquid to a reverse face of a bent flap of an enevelope received on said plane, said applying member having at an end thereof a structure which lifts an amount of said liquid from said storage means and causes any excess portion of the lifted amount to drop off of said applying member so as to allow only a limited amount of liquid to stick to said applying member.

7. An automatic envelope sealing device as claimed in claim 7, wherein said structure of said applying member is in the form of holes formed in said applying member to let an excessive amount of liquid sticking thereto drop off said applying member.

8. An automatic envelope sealing device as claimed in claim 6, wherein liquid to be stored in said liquid storing means is a bonding agent of the thermally meltable type.

9. An automatic envelope sealing device, comprising: a stationary supply table; a stationary receiving table; a bidirectional drive motor; first feeding means including a pair of cooperating rollers connected to be driven by said drive motor for feeding an envelope supplied from said supply table with the bottom directed forwardly in a direction to said receiving table; means for bending a flap of the envelope fed to said receiving table; applying means for applying liquid to a predetermined portion of the envelope; and second feeding means operable after liquid has been applied to the predetermined portion of the envelope for feeding the envelope reversely to said first means whereupon said rollers are driven to feed the envelope reversely to said supply table while the flap of the envelope is closed to seal the envelope by said rollers.

10. An automatic envelope sealing device as claimed in claim 16, wherein said second feeding means includes a roller located below and partially extending from said receiving table so as to engage with the envelope on said receiving table, said roller of said second feeding means being connected to be driven by said bidirectional drive motor, and a pressure element located above said roller of said second feeding means and said receiving table and operable to press the envelope on said receiving table against said roller of said second feeding means to allow the envelope to be fed toward said first feeding means after liquid has been applied to the predetermined portion of the envelope.

* * * * *

UNITED STATES PATENT AND TRADEMARK OFFICE

CERTIFICATE OF CORRECTION

PATENT NO. : 4,609,421

DATED : September 2, 1986

INVENTOR(S) : Yoshikazu Yui

It is certified that error appears in the above-identified patent and that said Letters Patent are hereby corrected as shown below:

Column 3, line 40, "beariung" should read --bearing--.

Column 3, line 51, "tble" should read --table--.

Column 7, line 2, "7" should read --6--.

Column 8, line 7, "16" should read --9--.

Signed and Sealed this

Thirteenth Day of January, 1987

*Attest:*

DONALD J. QUIGG

*Attesting Officer*

*Commissioner of Patents and Trademarks*